US009323191B2

(12) United States Patent
Moriguchi

(10) Patent No.: US 9,323,191 B2
(45) Date of Patent: Apr. 26, 2016

(54) FIXING DEVICE INCLUDING FIXING BELT, PRESSURE ROTATING BODY, NIP MEMBER, HEATING MEMBER, ROTATING MEMBER AND BIASING MEMBER AND IMAGE FORMING APPARATUS INCLUDING THE SAME

(71) Applicant: KYOCERA Document Solutions Inc., Osaka (JP)

(72) Inventor: Motoki Moriguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/507,873

(22) Filed: Oct. 7, 2014

(65) Prior Publication Data

US 2015/0104228 A1 Apr. 16, 2015

(30) Foreign Application Priority Data

Oct. 16, 2013 (JP) ..... 2013-215330

(51) Int. Cl.
*G03G 15/20* (2006.01)

(52) U.S. Cl.
CPC .... *G03G 15/2053* (2013.01); *G03G 2215/2016* (2013.01); *G03G 2215/2035* (2013.01)

(58) Field of Classification Search
CPC ..... G03G 15/2053; G03G 15/2064; G03G 2215/2016; G03G 2215/2035
See application file for complete search history.

(56) References Cited

U.S. PATENT DOCUMENTS

| | | | | |
|---|---|---|---|---|
| 8,655,244 | B2 | 2/2014 | Hasegawa et al. | |
| 2005/0185994 | A1* | 8/2005 | Inada et al. | 399/328 |
| 2006/0054467 | A1* | 3/2006 | Oishi | 198/835 |
| 2012/0195655 | A1* | 8/2012 | Tsunoda G03G 15/2053 | 399/330 |
| 2014/0056626 | A1* | 2/2014 | Sakai | 399/329 |
| 2014/0314459 | A1* | 10/2014 | Samei | 399/329 |

FOREIGN PATENT DOCUMENTS

JP 2011-81303 A 4/2011

* cited by examiner

*Primary Examiner* — David Gray
*Assistant Examiner* — Laura Roth
(74) *Attorney, Agent, or Firm* — Studebaker & Brackett PC

(57) ABSTRACT

A fixing device includes a fixing belt, a pressure rotating body, a nip member, a heating member, a rotating member and a biasing member. The fixing belt is arranged rotatably around a rotating axis. The pressure rotating body is rotatably arranged at an external diameter side of the fixing belt to come into pressure contact with the fixing belt and to form a fixing nip. The nip member is arranged at an internal diameter side of the fixing belt to press the fixing belt toward a side of the pressure rotating body. The heating member comes into contact with a contacted area in an inner circumference face of the fixing belt to heat the fixing belt. The rotating member sandwiches an end part of the fixing belt with the heating member and is rotated together with the fixing belt. The biasing member presses the heating member to the contacted area.

7 Claims, 6 Drawing Sheets

FIXING DEVICE INCLUDING FIXING BELT, PRESSURE ROTATING BODY, NIP MEMBER, HEATING MEMBER, ROTATING MEMBER AND BIASING MEMBER AND IMAGE FORMING APPARATUS INCLUDING THE SAME

INCORPORATION BY REFERENCE

This application is based on and claims the benefit of priority from Japanese Patent application No. 2013-215330 filed on Oct. 16, 2013, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine or a printer, includes a fixing device fixing a toner image onto a recording medium, such as a sheet. In the fixing device, a "heat roller manner" is widely applied in viewpoints of heat efficiency, safety and others. The heat roller manner is a manner using a pair of rollers to form a fixing nip. On the other hand, a "belt manner" recently attracts attention due to requests of shortening of a warm-up time, energy saving or others. The belt manner is a manner using a fixing belt to form the fixing nip.

For example, there is a fixing device including a fixing belt, a heating member fixedly arranged so as to face to an inner circumference face of the fixing belt, and a heat source fixedly arranged inside the heating member. In such a conventional technique, it is configured so that the heating member is heated by radiant heat of the heat source and the fixing belt is heated by the heating member.

In the above-mentioned conventional technique, because a gap is arranged between the inner circumference face of the fixing belt and heating member, there is a high possibility that contact of the inner circumference face of the fixing belt with the heating member becomes insufficient. If the contact of the inner circumference face of the fixing belt with the heating member thus becomes insufficient, it is not possible to efficiently carry out heat transfer from the heating member to the fixing belt. According to this, a problem that temperature rising rate of the fixing belt is lowered and a problem that the temperature of the heating member is excessively risen are caused in the warm-up. If the temperature of the heating member is thus risen excessively, there are possibilities that grease interposed between the fixing belt and heating member is vaporized and the heating member is deformed.

SUMMARY

In accordance with an embodiment of the present disclosure, a fixing device includes a fixing belt, a pressure rotating body, a nip member, a heating member, a rotating member and a biasing member. The fixing belt is arranged rotatably around a rotating axis. The pressure rotating body is arranged at an external diameter side of the fixing belt to come into pressure contact with the fixing belt so as to form a fixing nip, and arranged rotatably. The nip member is arranged at an internal diameter side of the fixing belt to press the fixing belt toward a side of the pressure rotating body. The heating member comes into contact with a contacted area arranged in an inner circumference face of the fixing belt to heat the fixing belt. The rotating member is arranged so as to sandwich an end part of the fixing belt with the heating member and to be rotated together with the fixing belt. The biasing member presses the heating member to the contacted area.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
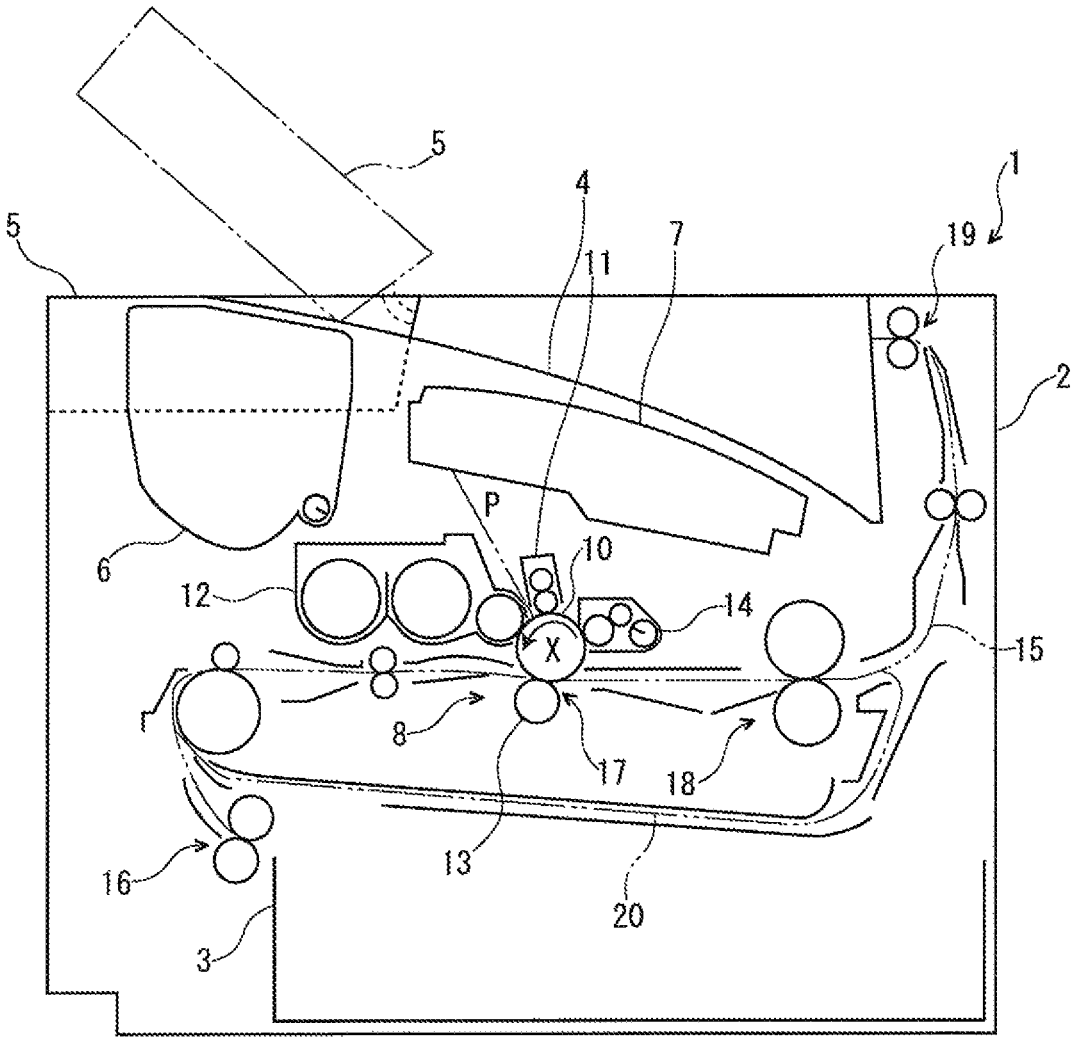
FIG. 1 is a schematic diagram schematically showing a printer according to a first embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, with reference to FIGS. 2-5, the fixing device 18 will be described in detail. Hereinafter, it will be described so that the front side of the fixing device 18 is positioned at the left side on FIG. 2, for convenience of explanation. An arrow Fr indicated in FIG. 2 indicates the front side of the fixing device 18. An arrow I indicated in FIG. 2 indicates the inside in forward and backward directions, and an arrow O in FIG. 2 indicates the outside in the forward and backward directions. An arrow Y in FIG. 3 indicates a conveying direction of the sheet.

Figure 2:
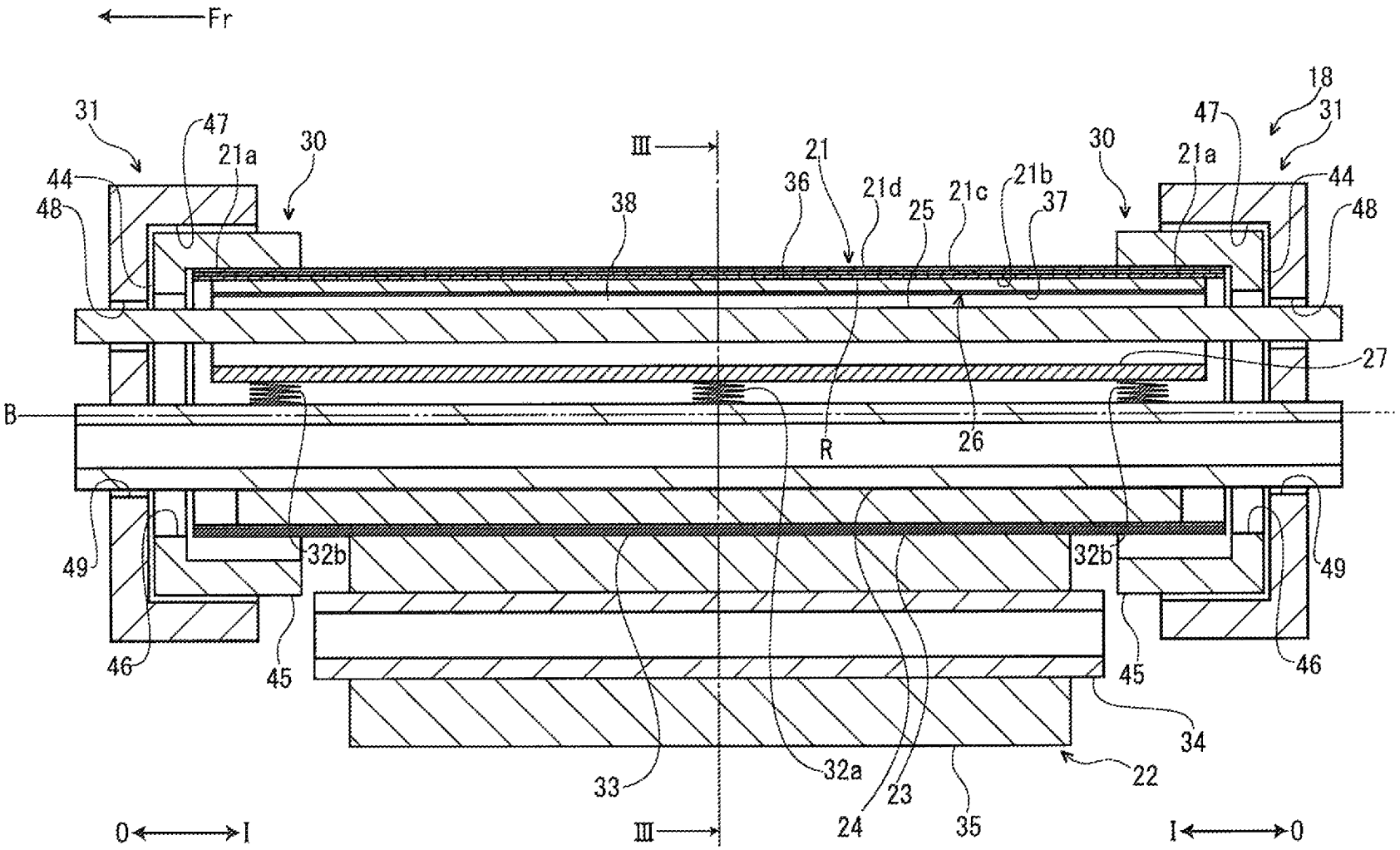
FIG. 2 is a lateral sectional view showing a fixing device in the printer according to the first embodiment of the present disclosure.
Figure 3:
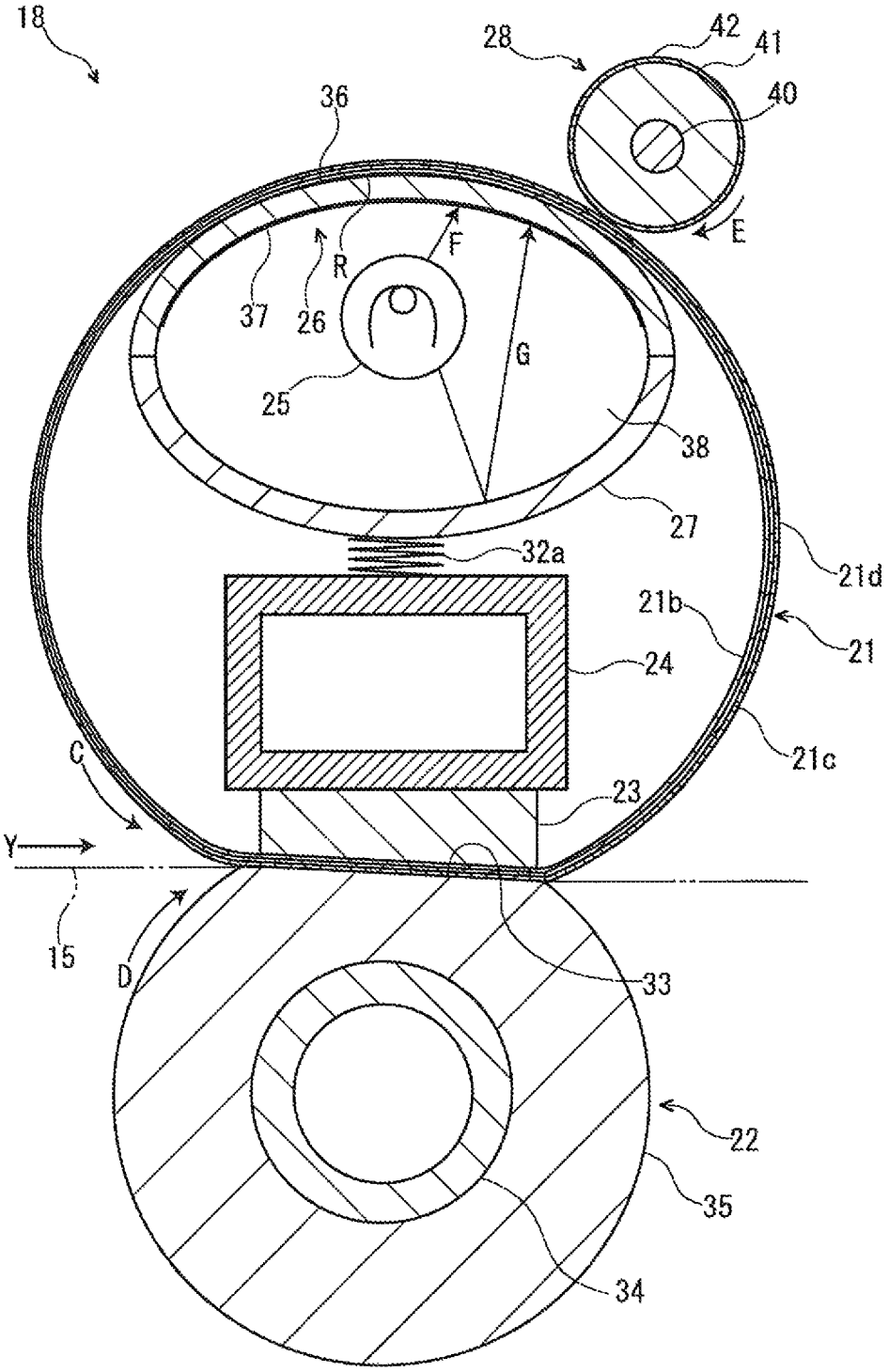
FIG. 3 is a sectional view taken along a line III-III of FIG. 2.

As shown in FIGS. 2 and 3, the fixing device 18 mainly includes a fixing belt 21, a pressuring roller 22 (a pressure rotating body), a nip member 23, a holding member 24, a heater 25 (a heat source), a heating member 26, a reflecting member 27, an auxiliary rotating body 28, a pair of pulleys 30 (rotating members), a pair of supporting members 31 and coil springs 32*a* and 32*b* (biasing members). The pressuring roller 22 is arranged at a lower side (at an external diameter side) of the fixing belt 21. The nip member 23 is arranged at an internal diameter side of the fixing belt 21. The holding member 24 is arranged at the internal diameter side of the fixing belt 21 and above the nip member 23. The heater 25 is arranged at the internal diameter side of the fixing belt 21 and above the holding member 24. The heating member 26 is arranged at the internal diameter side of the fixing belt 21 and at an upper side of the heater 25. The reflecting member 27 is arranged at the internal diameter side of the fixing belt 21 and at a lower side of the heater 25. The auxiliary rotating body 28 is arranged at a right upper side (at the external diameter side) of the fixing belt 21. The pulleys 30 are respectively arranged at both front and rear end parts 21*a* of the fixing belt 21. The supporting members 31 are arranged so as to hold the respective pulleys 30. The coil springs 32*a* and 32*b* are arranged at the internal diameter side of the fixing belt 21, and above the holding member 24 and below the reflecting member 27.

As shown in FIG. 2, the fixing belt 21 is formed in a roughly cylindrical shape elongated in the forward and backward directions. The fixing belt 21 has flexibility and is endless in a circumference direction. The fixing belt 21 is rotatably arranged around the rotating axis B extending in the forward and backward directions. That is, in the embodiment, the forward and backward directions equal to a rotating axis direction of the fixing belt 21.

The fixing belt 21 is composed of, for example, a base material layer 21*b*, an elastic layer 21*c* provided around the base material layer 21*b* and a release layer 21*d* covering the elastic layer 21*c* in order from the internal diameter side. The base material layer 21*b* of the fixing belt 21 is made of, for example, resin, such as polyimide (PI). The base material layer 21*b* of the fixing belt 21 has, for example, an internal diameter ϕ of 30 mm and a thickness of 90 μm. The elastic layer 21*c* of the fixing belt 21 is made of, for example, a silicone rubber. The elastic layer 21*c* of the fixing belt 21 has, for example, 5 degrees in JIS (Japanese Industrial Standard) hardness and a thickness of 200 μm. The release layer 21*d* of the fixing belt 21 is made of, for example, material (e.g. a perfluoro alkoxy alkane (PFA) tube) having heat resistance and toner releasability. The release layer 21*d* of the fixing belt 21 has, for example, a thickness of 30 μm.

The pressuring roller 22 is formed in a roughly cylindrical shape elongated in the forward and backward directions. The pressuring roller 22 is arranged in parallel to the fixing belt 21. The pressuring roller 22 is pressured to the upper side (a side of the fixing belt 21) with a predetermined load (e.g. 300N) by a pressuring mechanism (not shown) using a spring and others to come into pressure contact with the fixing belt 21. Thereby, between the fixing belt 21 and pressuring roller 22, a fixing nip 33 is formed. Both front and rear end parts of the pressuring roller 22 are rotatably supported by bearing members (not shown). The pressuring roller 22 is connected to a drive source (not shown) via a drive gear (not shown) provided in the printer main body 2 and configured to be rotated by the drive source. The above-mentioned drive source is composed of, e.g. a motor.

The pressuring roller 22 is composed of, for example, a cylindrical core metal 34, an insulation elastic layer 35 provided around the core metal 34 and a release layer (not shown) covering the insulation elastic layer 35 in order from the internal diameter side. The core metal 34 of the pressuring roller 22 is made of, e.g. metal, such as aluminum. The core metal 34 of the pressuring roller 22 has, for example, an external diameter ϕ of 26 mm. The insulation elastic layer 35 of the pressuring roller 22 is made of, for example, a silicone rubber. The insulation elastic layer 35 of the pressuring roller 22 has, for example, a thickness of 3 mm. The release layer of the pressuring roller 22 is made of, for example, a PFA tube. The release layer of the pressuring roller 22 has, for example, a thickness of 30 μm.

The nip member 23 is formed in a plate shape elongated in the forward and backward directions. The nip member 23 is made of, for example, a heat resistant resin, such as liquid crystal polymer (LCP). As shown in FIG. 3, a lower face of the nip member 23 is inclined toward a lower side (a side of the pressuring roller 22) from the left side (an upstream side in the conveying direction of the sheet) to the right side (a downstream side in the conveying direction of the sheet). The lower face of the nip member 23 presses the fixing belt 21 to the lower side (the side of the pressuring roller 22).

The holding member 24 is formed in a shape elongated in the forward and backward directions. The holding member 24 is made of, for example, metal, such as steel special use stainless (SUS), and is formed in a hollow square shaped section. To a lower face of the holding member 24, an upper face of the nip member 23 is fixed. Thereby, the nip member 23 is held by the holding member 24 and a warp in the forward and backward directions (a longitudinal direction) of the nip member 23 is restrained.

The heater 25 is composed of, for example, a halogen heater. The heater 25 is configured to generate heat by energization and to emit radiant heat (radiant light).

The heating member 26 is formed in a shape elongated in the forward and backward directions. The heating member 26 is made of metal material (e.g. aluminum) having heat conductivity and resilience. The heating member 26 is arranged movable in the upward and downward directions (the directions approaching to/separating from the pressuring roller 22).

The heating member 26 has, for example, a thickness of 0.5 mm. As shown in FIG. 3, in a center part in the left and right directions of the heating member 26, a contacting part 36 is provided. An outer circumference face of the contacting part 36 comes into contact with an upper area R (a contacted area) of an inner circumference face of the fixing belt 21. The contacting part 36 is curved in an arc shape toward the upper side (a side of the contacted area). In a lower face (an inside face) of the heating member 26, a photothermal converting part 37 is provided. The photothermal converting part 37 is formed, for example, by applying photothermal conversion coating, such as Okitsumo, onto the lower face of the heating member 26. The photothermal converting part 37 is arranged so as to cover at least an inner circumference face of the contacting part 36.

The reflecting member 27 is formed in a shape elongated in the forward and backward directions. The reflecting member 27 is made of, for example, bright aluminum. The reflecting member 27 is arranged movable in the upward and downward directions (the directions approaching to/separating from the pressuring roller 22).

The reflecting member 27 has, for example, a thickness of 0.5 mm. The reflecting member 27 is curved in an arc shape toward the lower side (a side approaching to the pressuring roller 22). Both left and right edge parts of the reflecting member 27 are joined to both left and right edge parts of the heating member 26. Thereby, an elliptic space 38 surrounded by the heating member 26 and reflecting member 27 is arranged and, in the elliptic space 38, the heater 25 is installed.

The auxiliary rotating body 28 is located inside each pulley 30 in the forward and backward directions. The auxiliary rotating body 28 is positioned at a downstream side of the fixing nip 33 in the rotating direction (refer to an arrow C in FIG. 3) of the fixing belt 21. The auxiliary rotating body 28 is rotatably arranged. The auxiliary rotating body 28 sandwiches the fixing belt 21 with the contacting part 36 of the heating member 26. The auxiliary rotating body 28 is pressed to an outer circumference face of the fixing belt 21 by a biasing body (not shown) to come into pressure contact with the outer circumference face of the fixing belt 21.

The auxiliary rotating body 28 is composed of, for example, a core metal 40, a foamed elastic layer 41 provided around the core metal 40 and a release layer 42 covering the foamed elastic layer 42 in order from the internal diameter side. The core metal 40 of the auxiliary rotating body 28 is made of, for example, metal, such as SUS. The core metal 40 of the auxiliary rotating body 28 has, for example, an external diameter of 6 mm. The foamed elastic layer 41 of the auxiliary rotating body 28 is made of, for example, a silicone foamed sponge. The foamed elastic layer 41 of the auxiliary rotating body 28 has, for example, a thickness of 2 mm. The release layer of the auxiliary rotating body 28 is made of, for example, a PFA tube. The release layer 42 of the auxiliary rotating body 28 has, for example, a thickness of 30 μm. Toner releasability of the release layer 42 of the auxiliary rotating body 28 is higher than the toner releasability of the release layer 21*d* of the fixing belt 21.

As shown in FIG. 2, each pulley 30 includes a meander regulating part 44 and a flange part 45 extending from an end part at an external diameter side of the meander regulating part 44 to the inside in the forward and backward directions.

The meander regulating part 44 of each pulley 30 is formed in an annular shape. In a center part of the meander regulating part 44, a through hole 46 is bored in the forward and backward directions and, in the through hole 46, the holding member 24 and heater 25 is penetrated. The meander regulating part 44 of each pulley 30 is positioned at the outside in the forward and backward directions of both front and rear end parts 21*a* of the fixing belt 21 to regulate a meandering (a deviation in the forward and backward directions) of the fixing belt 21.

The flange part 45 of each pulley 30 is formed in a cylindrical shape. Inner circumference face of the flange part 45 of each pulley 30 partially comes into contact with the outer circumference faces of both front and rear end parts 21*a* of the fixing belt 21. The flange part 45 of each pulley 30 is arranged so as to sandwich the both front and rear end parts 21*a* of the fixing belt 21 with the contacting part 36 of the heating member 26.

Figure 4:
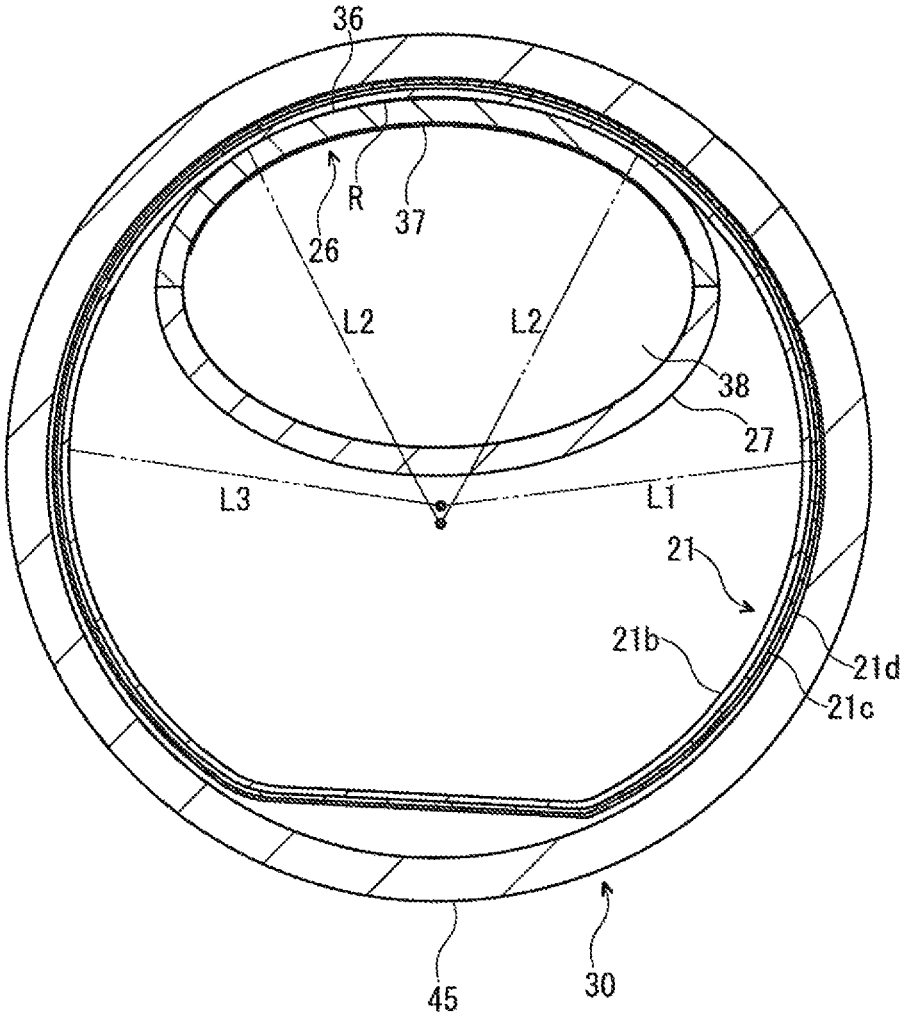
FIG. 4 is a sectional view showing a fixing belt, a heating member, a reflecting member and a pulley in the fixing device of the printer according to the first embodiment of the present disclosure.

As shown in FIG. 4, an internal diameter L1 of the flange part 45 of each pulley 30, an external diameter L2 (radius of curvature) of the contacting part 36 of the heating member 26 and an internal diameter L3 of the fixing belt 21 satisfy the relationship of $L1 \geq L2 \geq L3$.

As shown in FIG. 2, in a face inside in the forward and backward directions of each supporting member 31, a supporting concave part 47 is formed and, in the supporting concave part 47, a part outside in the forward and backward directions of each pulley 30 is inserted. Thereby, each pulley 30 is rotatably supported by each supporting member 31. With an inner circumference face of the supporting concave part 47 of each supporting member 31, an outer circumference face of each pulley 30 partially comes into contact.

Figure 5:
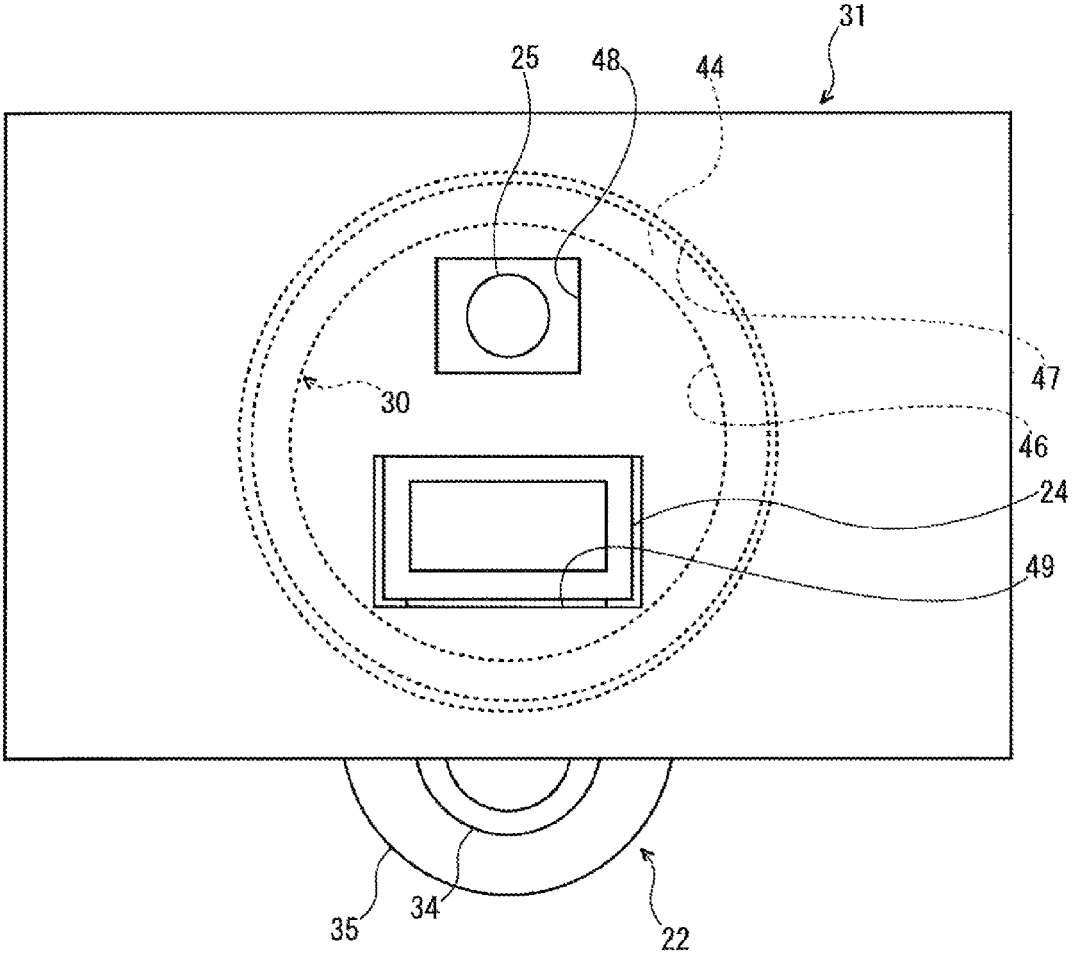
FIG. 5 is a front view showing the fixing device in the printer according to the first embodiment of the present disclosure.

As shown in FIG. 5 and other figures, in an upper part of each supporting member 31, a rectangular first insertion hole 48 is bored in the forward and backward directions. Through the first insertion hole 48 of each supporting member 31, both front and rear end parts of the heater 25 are inserted. Thereby, the heater 25 is supported by the each supporting member 31. In a lower part of each supporting member 31, a rectangular second insertion hole 49 is bored in the forward and backward directions. Through the second insertion hole 49 of each supporting member 31, both front and rear end parts of the holding member 24 are inserted. Thereby, the holding member 24 is supported by the each supporting member 31.

As shown in FIG. 2 and other figures, lower end parts of the coil springs 31*a* and 32*b* come into contact with a top face of the holding member 24. Upper end parts of the coil springs 31*a* and 32*b* come into contact with a lower end part of the reflecting member 27. That is, the coil springs 31*a* and 32*b* are interposed between the holding member 24 and reflecting member 27. The coil spring 31*a* at the center in the forward and backward directions is arranged so that its position in the forward and backward directions corresponds to that of the fixing nip 33. The coil springs 32*b* at both front and rear sides in the forward and backward directions are located at the outsides of the fixing nip 33 in the forward and backward directions so that their positions in the forward and backward directions correspond to those of the flange parts 45 of the pulleys 30.

The coil springs 31*a* and 32*b* bias the heating member 26 and reflecting member 27 toward the upper side (the side of the contacted area). Thereby, the contacting part 36 of the heating member 26 is pressed to the upper area R (the contacted area) of the inner circumference face of the fixing belt 21, and upper parts of the outer circumference faces of both front and rear end parts 21*a* of the fixing belt 21 are pressed to upper parts of the inner circumference faces of the flange parts 45 of the pulleys 30.

In the fixing device 18 configured as mentioned above, in order to fix the toner image onto the sheet, as indicated by an arrow D in FIG. 3, the drive source (not shown) works to rotate the pressuring roller 22. When the pressuring roller 22 is thus rotated, as indicated by an arrow C in FIG. 3, the fixing belt 21 coming into pressure contact with the pressuring roller 22 is co-rotated in an opposite direction to the pressuring roller 22 and the fixing belt 21 is slid with respect to the contacting part 36 of the heating member 26. Moreover, when the fixing belt 21 is rotated as mentioned above, as indicated by an arrow E in FIG. 3, the auxiliary rotating body 28 coming into pressure contact with the fixing belt 21 is co-rotated in an opposite direction to the fixing belt 21. In addition, when the fixing belt 21 is rotated as mentioned above, by friction force between both front and rear end parts 21*a* of the fixing belt 21 and the flange parts 45 of the pulleys 30, each pulley 30 is rotated together with the fixing belt 21 and each pulley 30 is slid with respect to each supporting member 31.

Moreover, in order to fix the toner image onto the sheet, the heater 25 is activated (lighted). When the heater 25 is thus activated, the heater 25 emits the radiant heat (the radiant light). The radiant heat emitted from the heater 25 to the heating member 26 is, as indicated by an arrow F in FIG. 3, directly absorbed by the heating member 26. The radiant heat emitted from the heater 25 to the holding member 24 is, as indicated by an arrow G in FIG. 3, reflected toward the heating member 26 by the reflecting member 27 and absorbed by the heating member 26. By the above-mentioned action, the heating member 26 is heated, and simultaneously, the fixing belt 21 is heated by heat conduction from the contacting part 36 of the heating member 26. In such a condition, when the sheet is passed through the fixing nip 33, the toner image is heated and melted, and then, the toner image is fixed onto the sheet.

In the embodiment, both front and rear end parts 21*a* of the fixing belt 21 are sandwiched between the contacting part 36 of the heating member 26 and the flange parts 45 of the pulleys 30. Therefore, it is possible to stabilize a rotation track of the fixing belt 21 and to make the inner circumference face of the fixing belt 21 securely come into contact with the contacting part 36 of the heating member 26. Therefore, it is possible to efficiently conduct heat quantity required for fixing the toner image onto the sheet from the heating member 26 to the fixing belt 21, to shorten warm-up time and to prevent image failure.

Moreover, by rotating each pulley 30 together with the fixing belt 21, it is possible to decrease a sliding load of the fixing belt 21 (a load required for rotating the fixing belt 21) as compared to a case of rotating the fixing belt 21 with respect to each pulley 30. Therefore, even if applying a configuration of rotating the fixing belt 21 by following rotation of the pressuring roller 22, it is possible to easily rotate the fixing belt 21. In addition, since both front and rear end parts 21*a* of the fixing belt 21 are not slid with respect to the flange parts 45 of the pulleys 30, it is possible to prevent both front and rear end parts 21*a* of the fixing belt 21 from being damaged.

By biasing upwardly the heating member 26 by the coil springs 32*a* and 32*b*, it is possible to press the contacting part 36 of the heating member 26 to the upper area R of the inner circumference face of the fixing belt 21, and to make the contacting part 36 of the heating member 26 more securely come into contact with the inner circumference face of the fixing belt 21. Further, since, by biasing force of the coil springs 32*a* and 32*b*, the upper parts of the outer circumference faces of both front and rear end parts 21*a* of the fixing belt 21 are pressed to the upper parts of the inner circumference faces of the flange parts 45 of the pulleys 30, it is possible to more securely rotate the pulleys 30 together with the fixing belt 21.

By arranging the elastic layer 21*c* in the fixing belt 21, even if the shape and size of the heating member 26 and each pulley 30 are displaced from design values, it is possible to absorb the above-mentioned displacement by deforming the elastic layer 21*c* in the fixing belt 21. Therefore, it is possible to make the contacting part 36 of the heating member 26 further securely come into contact with the inner circumference face of the fixing belt 21. In addition, since the elastic layer 21*c* is arranged in the fixing belt 21 and the internal diameter L1 of the flange part 45 of each pulley 30, the external diameter L2 of the contacting part 36 of the heating member 26 and the internal diameter L3 of the fixing belt 21 satisfy the relationship of $L1 \geq L2 \geq L3$, it is possible to improve adhesion between the inner circumference face of the fixing belt 21 and the contacting part 36 of the heating member 26 and adhesion between both front and rear end parts 21*a* of the fixing belt 21 and the flange parts 45 of the pulleys 30.

Since the heating member 26 is made of metal material having resilience, when the fixing belt 21 is deformed according to the rotation of the fixing belt 21, it is possible to deform the heating member 26 to a shape along the inner circumference face of the deformed fixing belt 21. Therefore, it is possible to make the contacting part 36 of the heating member 26 furthermore securely come into contact with the inner circumference face of the fixing belt 21.

The fixing belt 21 is sandwiched between the contacting part 36 of the heating member 26 and the auxiliary rotating body 28. By applying such a configuration, during rotation of the fixing belt 21, it is possible to stabilize a contact state of the inner circumference face of the fixing belt 21 and the contacting part 36 of the heating member 26.

Since the foamed elastic layer 41 is arranged in the auxiliary rotating body 28, it is possible to keep a width of the fixing nip 33 to some extent in the forward and backward directions and to make the contacting part 36 of the heating member 26 securely come into contact with the inner circumference face of the fixing belt 21. In addition, by arranging the foamed elastic layer 41 in the auxiliary rotating body 28, since heat quantity taken by the auxiliary rotating body 28 can be decreased, it is possible to restrain a restoring time (a time until the fixing device 18 is restored to a state of being capable of fixing the toner image onto the sheet) from being prolonged. Since the toner releasability of the release layer 42 of the auxiliary rotating body 28 is higher than the toner releasability of the release layer 21*d* of the fixing belt 21, it is possible to prevent the toner from adhering onto the release layer 42 of the auxiliary rotating body 28.

The fixing device 18 includes the holding member 24 holding the nip member 23, the heater 25 arranged at the inner diameter side of the fixing belt 21 to emit the radiant heat, and the reflecting member 27 reflecting the radiant heat emitted from the heater 25 toward the heating member 26. The coil springs 32*a* and 32*b* are interposed between the holding member 24 and reflecting member 27. By applying such a configuration, it is possible to concentrate the radiant heat emitted from the heater 25 on the heating member 26 and to efficiently heat the heating member 26. In addition, it is possible to install the coil springs 32*a* and 32*b* by simplified structure.

In the embodiment, a case where the toner releasability of the release layer 42 of the auxiliary rotating body 28 is higher than the toner releasability of the release layer 21*d* of the fixing belt 21 was described. On the other hands, in another embodiment, the toner releasability of the release layer 42 of the auxiliary rotating body 28 may be lower than the toner releasability of the release layer 21*d* of the fixing belt 21. By applying such a configuration, it is possible not only to more stabilize the contact state of the inner circumference face of the fixing belt 21 and the contacting part 36 of the heating member 26, but also to impart a function of cleaning the toner adhered onto the release layer 21*d* of the fixing belt 21 to the auxiliary rotating body 28.

Although, in the embodiment, a case of arranging the elastic layer 21*c* in the fixing belt 21 was described, in another embodiment, the fixing belt 21 may be provided without the elastic layer 21*c*. Although, in the embodiment, a case of arranging the foamed elastic layer 41 in the auxiliary rotating body 28 was described, in another embodiment, the auxiliary rotating body 28 may be provided without the foamed elastic layer 41.

Although, in the embodiment, a case of making the base material layer 21*b* of the fixing belt 21 by resin, such as PI (polyimide), was described, in another embodiment, the base material layer 21*b* of the fixing belt 21 may be made of metal, such as nickel or SUS. In a case of thus making the base material layer 21*b* of the fixing belt 21 by the metal, in order to improve slidability of the fixing belt 21 with respect to the nip member 23 and heating member 26, a sliding layer may be arranged at the inner diameter side of the base material layer 21*b* in the fixing belt 21. The sliding layer is made of, for example, PI (polyimide) or a fluorine-based resin.

Although the description in the embodiment was omitted, in another embodiment, in order to improve slidability of the fixing belt 21 with respect to the nip member 23, a slide contact member may be interposed between the fixing belt 21 and nip member 23. The slide contact member is made of, for example, a glass sheet of polytetrafluoroethylene (PTFE) or the like.

Although, in the embodiment, a case of making the heating member 26 by aluminum was described, in another embodiment, the heating member 26 may be made of metal material (e.g. SUS) having resilience except for aluminum.

In the embodiment, a case of joining the heating member 26 and reflecting member 27 formed separately was described. On the other hand, in another embodiment, the heating member 26 and reflecting member 27 may be formed in a body. In such a case, the heating member 26 and reflecting member 27 are formed in a body, for example, by bright aluminum having a thickness of 0.5 mm, and then, onto an inside face of a portion corresponding to the heating member 26 (a portion coming into contact with the inner circumference face of the fixing belt 21), photothermal conversion coating, such as Okitsumo, may be applied.

Although the description in the embodiment was omitted, in another embodiment, lubricant may be applied between the fixing belt 21 and nip member 23 and between the fixing belt 21 and heating member 26. By applying such a configuration, it is possible to improve slidability of the fixing belt 21 with respect to the nip member 23 and heating member 26. In addition, lubricant may be applied between each pulley 30 and each supporting member 31. By applying such a configuration, it is possible to improve slidability of each pulley 30 with respect to each supporting member 31. Incidentally, as the above-mentioned lubricant, fluorine grease, silicone grease, silicone oil or the like may be used.

Although, in the embodiment, a case of using the heater 25 composed of the halogen heater as the heat source was described, in another embodiment, a ceramic heater, an IH (Induction Heating) coil or the like may be used as the heat source.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Second Embodiment

Figure 6:
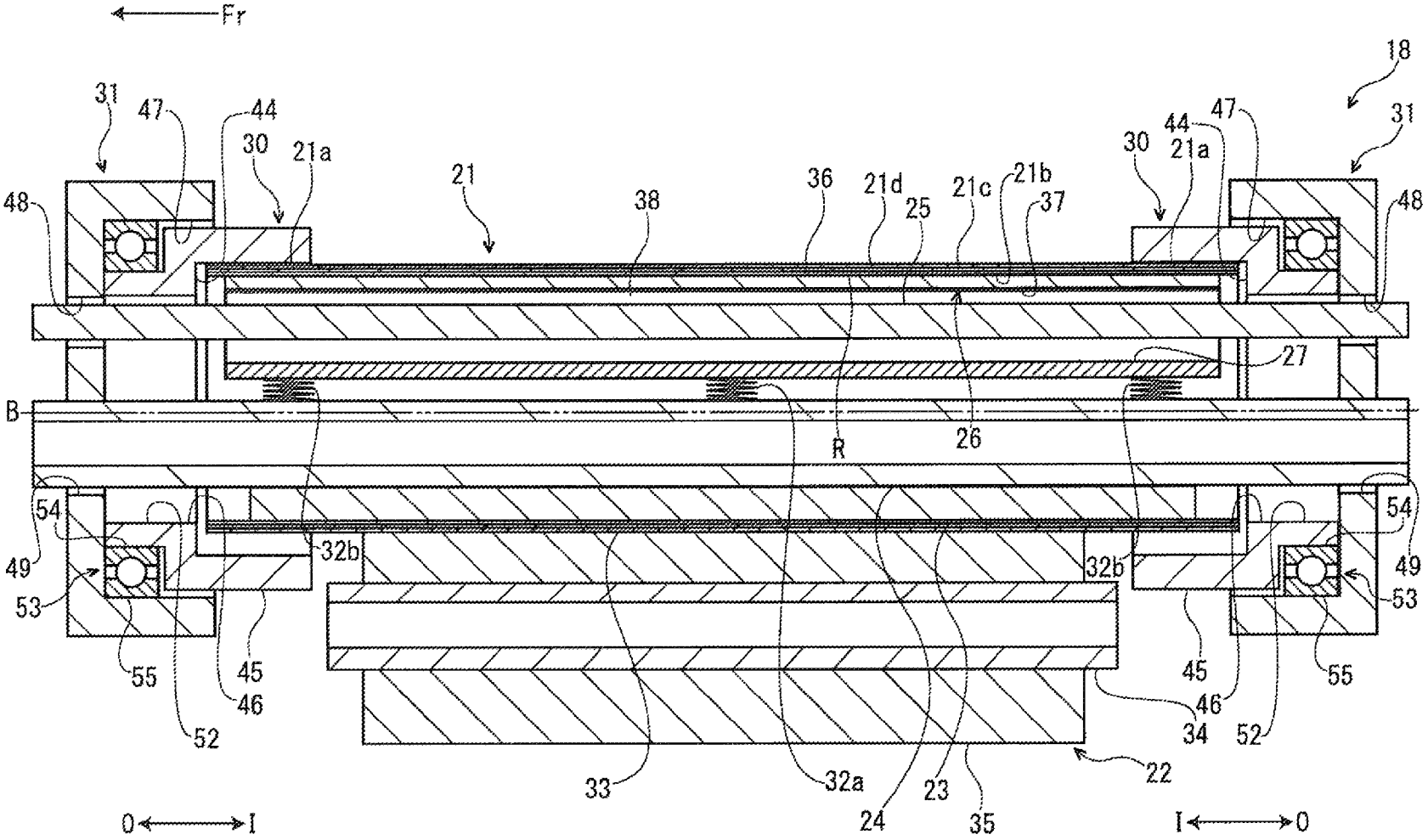
FIG. 6 is a lateral sectional view showing the fixing device in the printer according to a second embodiment of the present disclosure.

Next, a second embodiment of the present disclosure will be described with reference to FIG. 6. Hereinafter, it will be described so that the front side of the fixing device 18 is positioned at the left hand side on FIG. 6, for convenience of explanation. An arrow Fr indicated in FIG. 6 indicates the front side of the fixing device 18. An arrow I indicated in FIG. 6 indicates the inside in forward and backward directions, and an arrow O indicated in FIG. 6 indicates the outside in the forward and backward directions. Incidentally, the same or corresponding components with those of the first embodiment mentioned above will be denoted by the same reference numerals in FIG. 6 and their explanation will be omitted.

In each pulley 30, a cylindrical installation part 52 is arranged so as to extend from an end part at the inner diameter side of the meander regulating part 44 to the outside in the forward and backward directions. Between the installation part 52 and the supporting concave part 47 of each supporting member 31, a bearing 53 is interposed. Each bearing 53 is composed of, for example, a ball bearing. An inner circumference part 54 of each bearing 53 comes into contact with an outer circumference face of the installation part 52 and an outer circumference part 55 of each bearing 53 comes into contact with the inner circumference face of the supporting concave part 47 of each supporting member 31. In each supporting member 31, a rotation stopper (not shown) preventing the outer circumference part 55 of each bearing 53 from being rotated is arranged.

In the above-mentioned configuration, when each pulley 30 is rotated together with the fixing belt 21, the inner circumference part 54 of each bearing 53 is rotated together with the each pulley 30. On the other hand, the outer circumference part 55 of each bearing 53 and each supporting member 31 are kept in a stop state.

In the second embodiment, as mentioned above, each bearing 53 is interposed between each pulley 30 and each supporting member 31. By applying such a configuration, it is possible to decrease a sliding load of each pulley (a load required for rotating each pulley 30) and to easily rotate each pulley 30 together with the fixing belt 21.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably around a rotating axis;

a pressure rotating body arranged at an external diameter side of the fixing belt to come into pressure contact with the fixing belt so as to form a fixing nip, and arranged rotatably;

a nip member arranged at an internal diameter side of the fixing belt to press the fixing belt toward a side of the pressure rotating body;

a heating member coming into contact with a contacted area arranged in an inner circumference face of the fixing belt to heat the fixing belt;

a rotating member arranged so as to sandwich an end part of the fixing belt with the heating member and to be rotated together with the fixing belt;

a biasing member pressing the heating member to the contacted area, and an auxiliary rotating body arranged so as to sandwich the fixing belt with the heating member, wherein the auxiliary rotating body includes:

a foamed elastic layer; and a release layer covering the foamed elastic layer, wherein the release layer of the auxiliary rotating body has a toner releasability higher than a toner releasability of a release layer of the fixing belt.

2. The fixing device according to claim 1, further comprising:

a supporting member supporting the rotating member; and a bearing interposed between the rotating member and supporting member.

3. The fixing device according to claim 1, wherein, the auxiliary rotating body is positioned at a downstream side of the fixing nip in a rotating direction of the fixing belt.

4. The fixing device according to claim 1, further comprising:

a holding member holding the nip member;

a heat source arranged at the internal diameter side of the fixing belt to emit radiant heat; and a reflecting member reflecting the radiant heat emitted from the heat source toward the heating member, wherein the biasing member is interposed between the holding member and reflecting member.

5. The fixing device according to claim 4, wherein, both edge parts of the reflecting member are joined to both edge parts of the heating member and the heat source is installed in a space surrounded by the heating member and reflecting member.

6. The fixing device according to claim 1, wherein, at least a part of the end part of the fixing belt is pressed to the rotating member by biasing force of the biasing member.

7. An image forming apparatus comprising:

the fixing device according to claim 1.

* * * * *